US005606923A

United States Patent [19]

Fujimori

[11] Patent Number: 5,606,923

[45] Date of Patent: Mar. 4, 1997

[54] INCINERATOR WITH A RECOMBUSTION CHAMBER

[76] Inventor: Minoru Fujimori, 706, Daigosinosaka Bldg., 3-12-15, Nishinakajima, Yodogawaku, Osaka, Japan

[21] Appl. No.: 371,818

[22] Filed: Jan. 12, 1995

[51] Int. Cl.[6] ..... F23B 5/00

[52] U.S. Cl. ..... 110/211; 110/345; 110/346

[58] Field of Search ..... 110/210, 211, 110/212, 215, 345, 346

[56] References Cited

U.S. PATENT DOCUMENTS

| | | | |
|---|---|---|---|
| 3,310,009 | 3/1967 | Jacobs | 110/212 |
| 3,792,671 | 2/1974 | Woods | 110/212 |
| 3,812,795 | 5/1974 | Bowles, Jr. | 110/212 |
| 4,416,855 | 11/1983 | Abrams et al. | 110/215 |
| 4,557,203 | 12/1985 | Mainord | 110/210 |
| 4,969,405 | 11/1990 | Goodrich | 110/210 |
| 5,095,826 | 3/1992 | Erisson et al. | 110/212 |

FOREIGN PATENT DOCUMENTS

| | | | |
|---|---|---|---|
| 880068 | 9/1971 | Canada | 110/215 |
| 0548387A1 | 12/1991 | European Pat. Off. . | |

*Primary Examiner*—Thomas E. Denion
*Attorney, Agent, or Firm*—Ladas & Parry

[57] ABSTRACT

An incinerator suitable for incineration of medical wastes is disclosed. The incinerator includes a main combustion chamber with fire-resistant walls, a port for ventin combustion gas therefrom and a main burner in the front section of the chamber. A recombustion chamber is placed above the main combustion chamber and includes fire-resistant walls and has a recombustion burner in a rear section of the recombustion chamber and receives the combustion gas from the main chamber through the port. An exhaust chamber vents pollution free combustion gas from the recombustion chamber to the atmosphere. The port for introducing the combustion gas of the main combustion chamber to the recombustion chamber is positioned such that the port is spaced apart from the center of a flame of the recombustion burner to enable the combustion gas introduced into the recombustion chamber come into cross contact with the flame of the recombustion burner.

4 Claims, 3 Drawing Sheets

INCINERATOR WITH A RECOMBUSTION CHAMBER

BACKGROUND OF THE INVENTION

1. Field of the Invention

The present invention relates to incinerators used to incinerate noxious medical wastes as well as general combustible wastes and, more particularly, to a structural improvement in such incinerators which enables the complete removal of unburned noxious high molecular materials entrained in the combustion gas present in the main combustion chamber and the deodorization and sterilization of the combustion gas prior to venting the combustion gas into the environment to thereby prevent the vented combustion gas from polluting the environment.

2. Description of the Prior Art

The prior art waste incinerators include a main combustion chamber which includes fire-resistant walls, with the front section of the chamber having a main burner. The incinerator also includes a recombustion chamber placed above the main combustion chamber which includes fire-resistant walls in the same manner as the main combustion chamber, with the rear section of the recombustion chamber having a recombustion burner. The main combustion chamber vents its combustion products to the recombustion chamber through a port formed between the main combustion chamber and the recombustion chamber. The port enables the combustion products of the main combustion chamber to flow into the recombustion chamber.

In the typical incinerator, especially those used for the incineration of noxious medial wastes such as syringes, injection needles, blood packs, medical gloves, medical tubes, or the like, the nearly complete removal of unburnt noxious high molecular materials entrained in the combustion gas flowing from the main combustion chamber and of the accompanying odor of the combustion gas being vented into the environment is needed. In order to achieve the above object, it is preferred to carry out the incineration of such medical wastes by providing that the flame of the recombustion burner perpendicularly contact the center of the combustion gas flow, including the unburnt materials, as the main combustion chamber combustion gas flows into the recombustion chamber along with the upward flow of the combustion gas through the port and into the recombustion chamber.

However, it has been noted that in incinerating such medial wastes by trying to position the flames of the recombustion burner so as to perpendicularly contact the center of the flow of unburnt gas introduced from the main combustion chamber to the recombustion chamber along with the upward current through the port, a problem results. That is, the unburnt gas is directly thrust into the chimney due to the injection pressure of the flame so that the unburnt gas fails to sufficiently contact the flame thus preventing the thermal decomposition of the matter comprising the unburnt gas.

Therefore, the incineration of such medical wastes using the above described typical incineration generates waste materials such as hydrogen chloride from polyvinyl chloride (PVC) and nylon resin and also results in unburnt gaseous heavy metals, such as mercury, cadmium and lead, remaining in the recombustion chamber. Thus the typical incinerator causes environmental pollution due to the noxious gases present in the combustion gas being vented into the atmosphere.

SUMMARY OF THE INVENTION

It is, therefore, an object of the present invention to provide an incinerator which overcomes the problem of the prior art incinerators and which nearly completely removes unburned noxious high molecular materials entrained in the combustion gas of the main combustion chamber and deodorizes and sterilizes the combustion gas prior to venting the combustion gas into the atmosphere, thus preventing the vented combustion gas from polluting the environment.

In order to accomplish the above object, a preferred embodiment of the invention is an incinerator which comprises a main combustion chamber which includes fire-resistant walls and a main burner in the front section of the main combustion chamber, a recombustion chamber positioned above the main combustion chamber and which also includes fire-resistant walls with a recombustion burner in the rear section of the chamber and receiving combustion gas from the main combustion chamber through a port, and an exhaust chamber for exhausting combustion gas of the recombustion chamber to the atmosphere, wherein the port for introducing the combustion gas of the main combustion chamber into the recombustion chamber is positioned such that the port is laterally spaced apart relative to the flame of the recombustion burner to enable the combustion gas vented into the recombustion chamber to come into cross contact with the flame of the recombustion chamber.

The recombustion chamber preferably includes a gas guide wall extending above the port in the front of the port, which gas guide wall guides the combustion gas introduced into the recombustion chamber through the port so that the unburnt gas comes into contact with the flame of the recombustion burner. The gas guide wall is preferably bent in a flame throwing direction of the recombustion burner so that the gas guide wall promotes the gas agitation.

The recombustion chamber preferably includes a gas guide wall extending above the port and positioned in the front of the port, for guiding the combustion gas introduced into the recombustion chamber through the port so that the unburnt gas comes into contact with the flame of the recombustion burner. The gas guide wall is preferably bent in a flame throwing direction of the recombustion burner so that the gas guide wall promotes the gas agitation.

The incinerator completely oxidizes, in the recombustion chamber, the noxious unburnt gas of the combustion gas of the main combustion chamber and further includes means for neutralizing hydrogen chloride remaining in the combustion gas of the recombustion chamber and removes the hydrogen chloride from the exhaust combustion gas.

The neutralizing means comprises an injector nozzle positioned vertically at the bottom of the exhaust chamber, the injector nozzle being adapted for letting the combustion gas of the recombustion chamber whirl upward about the injection nozzle and exhausted into the atmosphere; and a chemical nozzle fitted into injection nozzle and connected to a chemical tank through a chemical distributing pipe line, whereby a chemical of the chemical tank is sprayed from the chemical nozzle into the exhaust chamber so that the sprayed chemical comes into pressure reducing contact with the combustion gas whirling upward about the injector nozzle and neutralizes the hydrogen chloride of the combustion gas prior to the exhausting of the combustion gas into the atmosphere.

In order to incinerate the many varieties of medical wastes gathered from numerous medical institutions and packaged in 20 liter safety packs, an incineration truck provided with the incineration of the invention is parked on a place suitable for incineration of such medical wastes. After parking the truck on the suitable place, a chimney cover is opened and a chimney is extended out of the top of the container box. An injector blower is started so that the combustion gas of the recombustion chamber can be forcibly exhausted into the atmosphere.

Thereafter, the recombustion burner is ignited so that the temperature of the recombustion chamber is raised. When the temperature of the recombustion chamber has reached about 1000° C., the waste door of the main combustion chamber is opened and the 20 liter safety packs containing medical waste are put into the main combustion chamber so that safety packs are heaped on the bottom of the main combustion chamber. The waste door is closed and the main burner is ignited so as to raise the temperature of the main combustion chamber to about 850° C., thus to incinerate the medical waste.

The combustion gas including the noxious unburnt gas of the main combustion chamber is introduced into the recombustion chamber along with the upward current through the port. In the recombustion chamber, the unburnt gas is contacted again by the flame of the recombustion burner. At this time, the unburnt gas comes into cross contact with the flame of the recombustion burner since the port is laterally spaced apart relative to the flame of the recombustion burner. The unburnt gas thus whirls so as to be sufficiently agitated and slowly sucked into the flame of the recombustion burner. The unburnt gas, therefore, resides in the recombustion chamber for a time sufficient for the complete combustion of the unburnt gas.

When using the incinerator having the recombustion chamber with the gas guide wall extending above the port in the front of the port, the unburnt gas introduced into the recombustion chamber whirls along the gas guide wall and comes into complete contact with the flame of the recombustion burner. In addition, when the gas guide wall is bent in the flame throwing direction of the recombustion burner, the unburnt gas will be more smoothly sucked into the flame of the recombustion burner and the gas agitation effect will be more improved.

The combustion gas of the recombustion chamber is introduced into the combustion gas exhaust chamber through the flue duct and whirls upward about the injector nozzle of the exhaust chamber and is exhausted to the atmosphere.

In order to completely oxidize, in the recombustion chamber, the noxious unburnt gas of the combustion chamber of the main combustion chamber and to neutralize the noxious hydrogen chloride remaining in the combustion gas of the recombustion chamber, a chemical is sprayed from the chemical nozzle, which nozzle is fitted into the injector nozzle and connected to the chemical tank through the chemical distributing pipe line. Therefore, the sprayed chemical comes into pressure reducing contact with the combustion gas whirling upward about the injector nozzle and neutralizes the hydrogen chloride of the combustion gas prior to the exhausting of the combustion gas into the atmosphere.

After finishing the medical waste incinerator process comprising the main combustion process, the recombustion process and the neutralization of the noxious gas is of the exhaust combustion gas, the main burner and the recombustion burner are shut down. Thereafter, the combustion blower is stopped so as to reduce the temperature of the main combustion chamber. When the temperature of the main combustion chamber is reduced to a predetermined temperature range of 200° C.–250° C., the ash door of the main combustion chamber is opened and the ash from the combustion of the medical waste is removed from the main combustion chamber.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
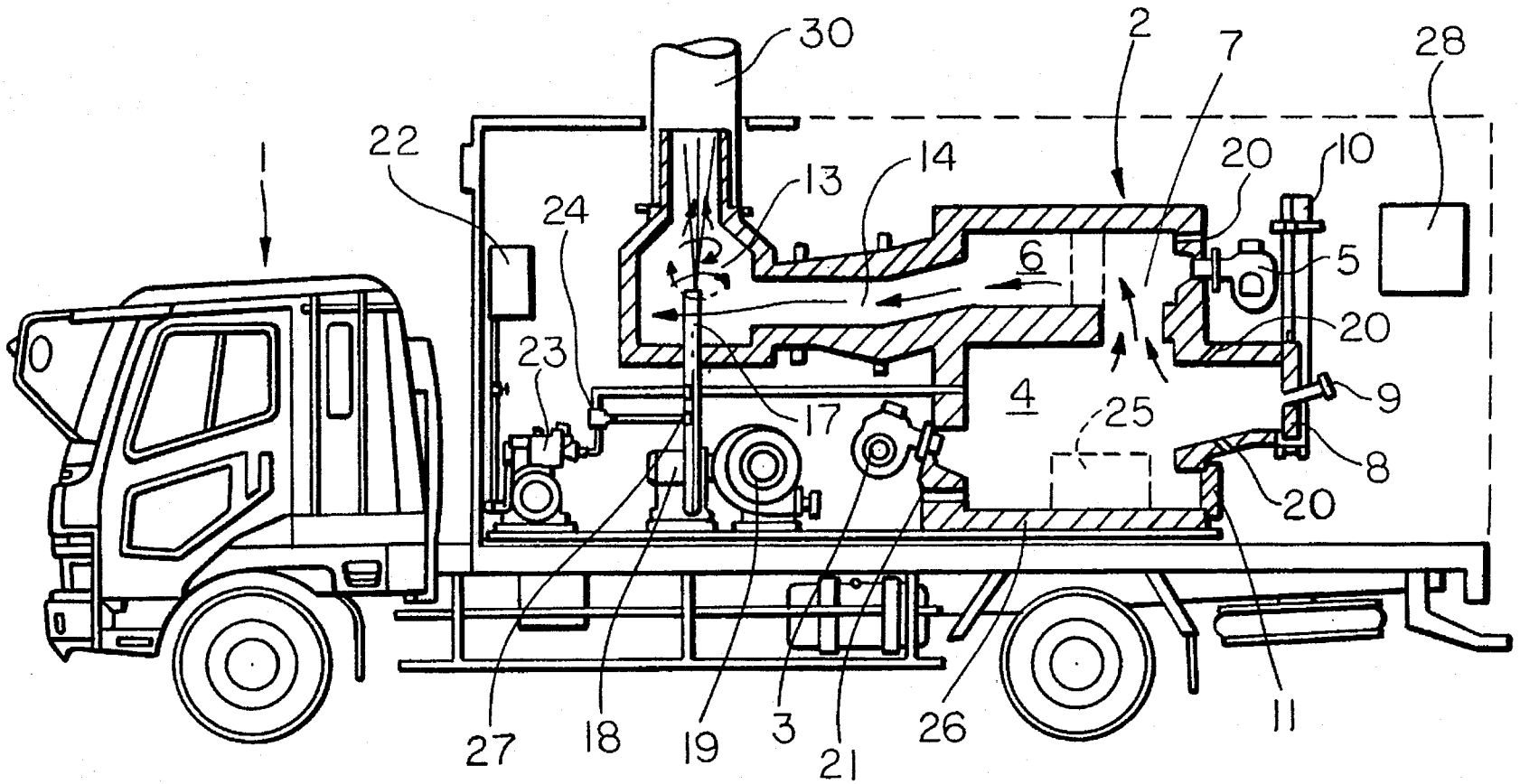
FIG. 1 is a side sectional view of an incinerator in accordance with a preferred embodiment of the present invention, showing the construction of the incinerator installed on an incineration truck.
Figure 2:
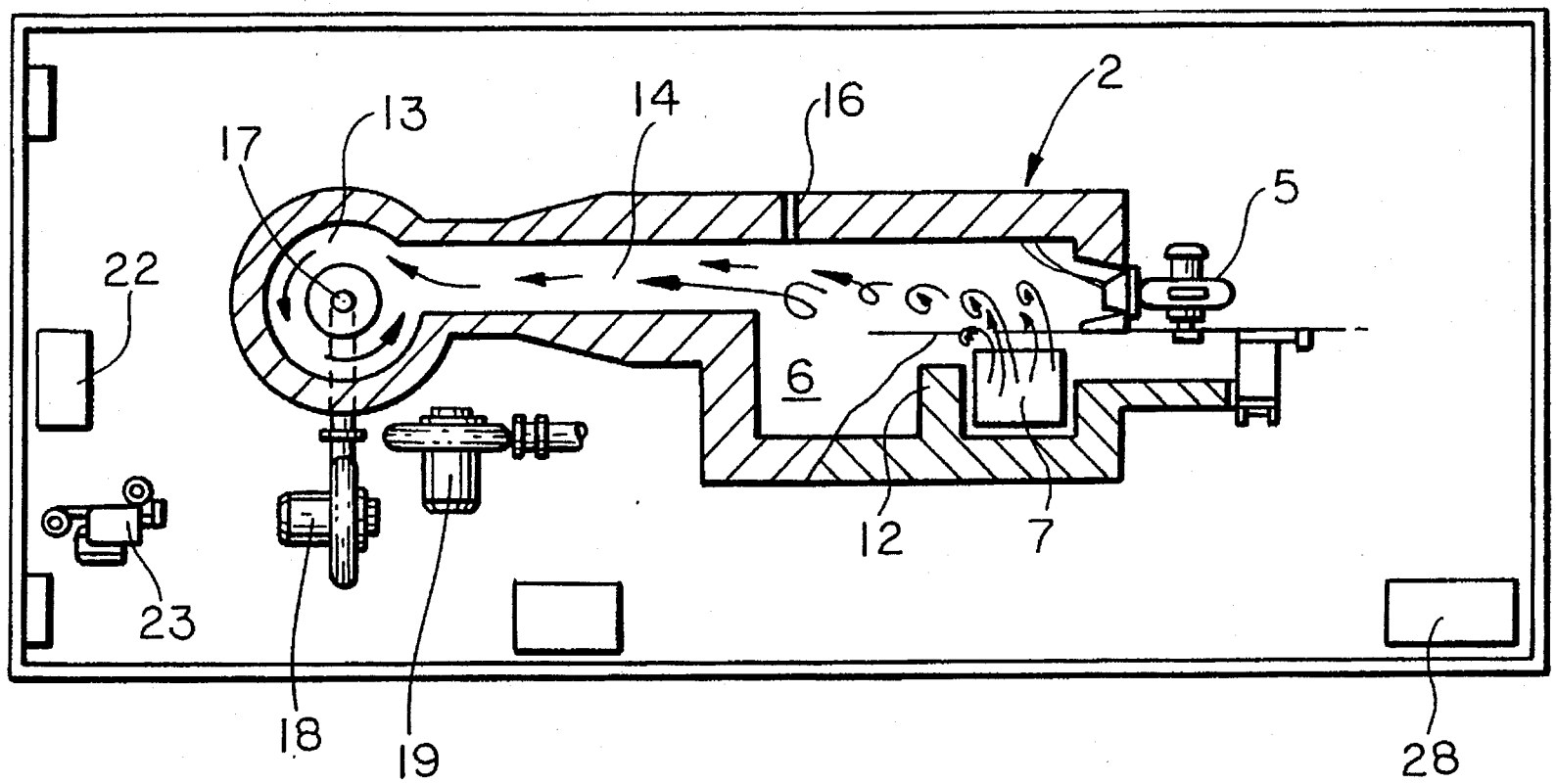
FIG. 2 is a plan sectional view of the incinerator according to the present the invention.
Figure 3:
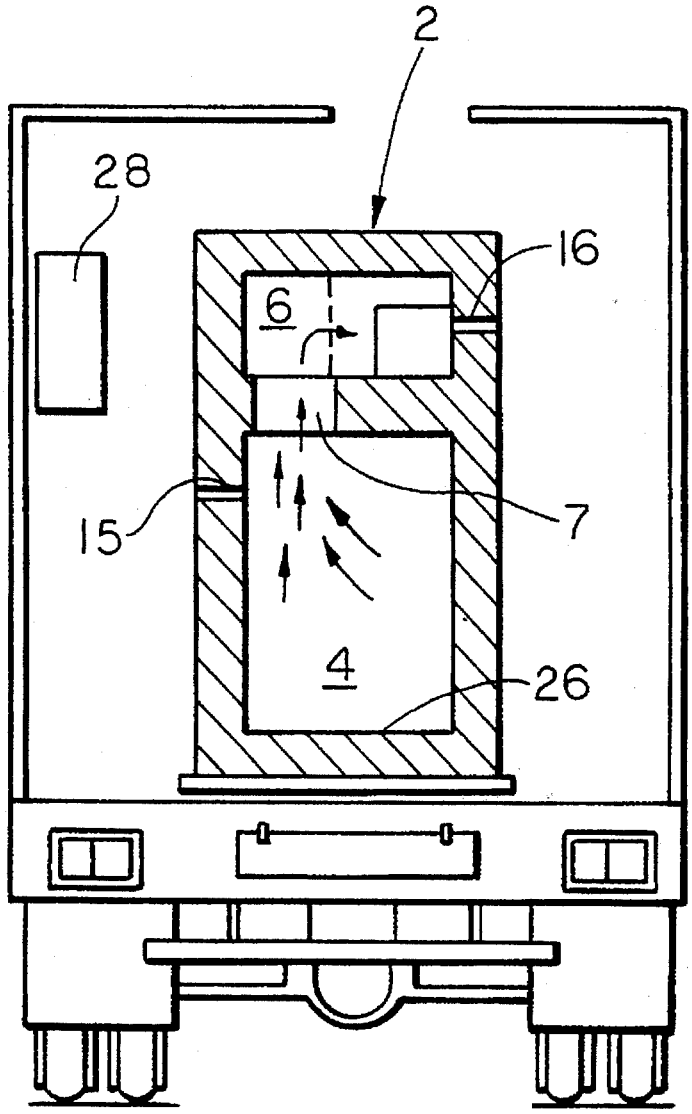
FIG. 3 is a front sectional view of the incinerator according to the present the invention.

With reference to the drawings, FIG. 1 is a side sectional view of the incinerator in accordance with a preferred embodiment of the present invention, showing the construction of the incinerator installed on an incineration truck. FIG. 2 is a plan sectional view of the incinerator according to the present invention. FIG. 3 is a front sectional view of the incinerator according to the present invention.

The incinerator of the invention is particularly used for the incineration of a variety of medical wastes collected from medical institutions and packaged in 20 liter safety packs. As shown in FIG. 1, the incinerator 2 is preferably installed in a container box loaded on an incineration truck 1.

The incinerator 2 includes a main combustion chamber 4 with fire-resistant walls constructed of ceramic fiber blocks and high strength moldable fire-resistant material, the front section of the main combustion chamber is provided with a main burner 3. The incinerator 2 also includes a recombustion chamber 6 that is placed above the main combustion chamber 4 and which includes fire-resistant walls constructed of ceramic fiber blocks, the rear section the recombustion chamber is provided with a recombustion burner 5. The main combustion chamber 4 vents into the recombustion chamber 6 through a port 7 formed between the main combustion chamber 4 and the recombustion chamber 6.

The rear section of the main combustion chamber 4 is provided with a waste door 8 for inserting waste into the main combustion chamber 4. The waste door 8 has a window 9 for observing the interior of the main combustion chamber 4 from the outside of the chamber 4. The waste door 8 is freely operated by a lifting unit 10 so that the door 8 is moved vertically in order to open or close access to the interior of the combustion chamber 4. Provided in the rear section of the main combustion chamber 4 under the waste door 8 is an ash door 11 for removing ash out of the chamber 4.

The main combustion chamber 4 is also provided with a thermocouple 15 operatively positioned on a fire-resistant wall, as shown in FIG. 3, which indicates the temperature of the main combustion chamber 4 at the port 7.

As shown in FIG. 2, the recombustion chamber 6 includes a gas guide wall 12 extending above the port 7 and in the front of the port 7. With the gas guide wall 12, the unburnt gas introduced from the main combustion chamber 4 into the recombustion chamber 6 through the port 7 is guided in the direction as shown at the arrow of FIG. 2 so that the unburnt gas is sucked into the effective space of the flame of the recombustion burner 5 little by little and totally comes into contact with the flame of the burner 5 in the effective space, thus to achieve the desired complete combustion of the unburnt gas. Therefore, there is no unburnt gas introduced into a combustion gas exhaust chamber 13 which will be described later herein.

In the same manner as described for the main combustion chamber 4, the side wall of the recombustion chamber 6 is provided with a thermocouple 16 to indicate the temperature of the gas outlet section of the recombustion chamber 6. The temperatures of the main combustion chamber 4 and of the recombustion chamber 6 may be controlled by a control unit in accordance with temperatures indicated by the thermocouples 15 and 16 and, in this regard, the incinerator 2 may be automatically operated.

In the embodiment shown in FIG. 2, the gas guide wall 12 extends straight, however, it should be understood that the top section of the wall 12 may be smoothly bent in the flame throwing direction of the recombustion burner 5 or toward the exhaust chamber 13.

Turning to FIG. 1, a combustion blower 19 is placed in the front of the main burner 3. The combustion blower 19 is connected to a pair of air inlet ports 20 of the main combustion chamber 4 through air pipes (not shown) and to an air inlet port 20 of the recombustion chamber 6 through an air pipe (not shown), thus to supply the combustion air to both chambers 4 and 6 and to promote waste combustion in the chambers 4 and 6. In addition, the lower section of the front wall of the main combustion chamber 4 under the main burner 3 is provided with a secondary air inlet port 21 for naturally introducing the secondary air into the main combustion chamber 4. With the air inlet ports 20 and 21, the combustion chambers 4 and 6 are supplied with a sufficient amount of combustion air so that the combustion efficiency of the incinerator 2 is improved. As the air inlet ports 20 and 21 cause forcible introduction of the outlet air into the combustion chamber 4 and 6, the air inlet ports 20 and 21 promote the upward air current in the chambers 4 and 6.

As shown in FIGS. 2 and 3, the exhaust chamber 13 is placed aside the recombustion chamber 6 and connected to the chamber 6 through a flue duct 14 so that the exhaust chamber 13 is supplied with combustion gas from the recombustion chamber 6. The injector nozzle 17, which vertically extends from an injector blower 18 placed under the exhaust chamber 13, is inserted into the chamber 13 and extends to about the center of the interior of the chamber 13. Therefore, the combustion gas of the recombustion chamber 6 introduced into the exhaust chamber 13 is exhasuted to the outside of the incinerator 2 or to the atmosphere through a vertically extending chimney 30 when the pressurized air of the injector blower 18 is released vertically from the injector nozzle 17 in the exhaust chamber 13.

A chemical tank 22 for containing a chemical, such as caustic soda or limewater, is placed in the front section of the interior of the container box as shown in FIG. 1. The chemical of the chemical tank 22 is pumped by a pressure pump 23 and supplied to a chemical distributing pipe line 24, which pipe line 24 distributes the pressurized chemical to the interior of the main combustion chamber 4 and to the interior of the injector nozzle 17. In the incinerator, the chemical of the chemical tank 22 is not always distributed to the main combustion chamber 4 but supplied to the chamber 4 as an emergency use for reducing a sudden increase of temperature in the main combustion chamber 4. The pressurized chemical supplied to the interior of the nozzle 17 comes into temperature reducing contact with the combustion gas and neutralizes noxious gases such as hydrogen chloride included in the combustion gas, which combustion gas whirls upward about the nozzle 17 and is exhausted to the atmosphere.

When caustic soda is the chemical supplied from the chemical tank 22 to the nozzle 17, the caustic soda comes into the temperature reducing contact with the hydrogen chloride included in the combustion gas of incinerator 2 and reacts with the hydrogen chloride to form water and sodium chloride as represented by the following formula, thereby preventing the exhaust of noxious gases to the atmosphere.

$$NaOH+HCl \rightarrow NaCl+H_2O$$

The operational effect of the above incinerator will be described hereinbelow with reference to FIGS. 1 and 2.

In order to incinerate a variety of medical wastes collected from numerous medical institutions and packaged in 20 liter safety packs, the incineration truck 1 provided with the incinerator 2 is parked at a place suitable for the incineration of such medical wastes. After parking the truck 1 at the suitable location, a cover (not shown) of the chimney 19 is opened by operating a control box 28 provided in the rear section of the container box of the truck 1. Thereafter, the chimney 19 extends upward and projects out of the top of the container box. The injector blower 18 is started so that the combustion gas of the recombustion chamber 6 can be forcibly introduced into the combustion gas exhaust chamber 13 so as to be exhausted to the atmosphere.

When the waste incineration standby state of the incinerator has been achieved, the recombustion chamber 5 of the recombustion chamber 6 is ignited so that the inner temperature of the recombustion chamber 6 is raised. When the inner temperature of the recombustion chamber 6 has reached about 1000° C., the waste door 8 of the main combustion chamber 4 is opened by operating the door lifting unit 10 and the 20 liter safety packs 25 containing the medical wastes are put into the main combustion chamber 4 so that the safety packs 25 are heaped on the bottom 26 of the chamber 4. After putting the safety packs 25 in the main combustion chamber 4, the waste door 8 is closed and the main burner 3 is ignited so as to raise the temperature of the main combustion chamber 4 to about 850° C., thus to incinerate the waste. During incineration of the waste, the combustion oxygen or the combustion air is continuously supplied to the main combustion chamber 4 through the air inlet ports 20 and 21, thereby increasing the combustion efficiency of the main combustion chamber 4.

The combustion gas including the noxious unburnt gas of the main combustion chamber 4 is introduced into the recombustion chamber 6 along with the upward current through the port 7 as shown by the arrows of FIG. 1. In the recombustion chamber 6, the unburnt gas is contacted again by the flame of the recombustion burner 5. At this time, the unburnt gas comes into cross contact with the flame of the recombustion burner 5 as shown in FIG. 2 since the port 7 is laterally spaced apart relative to the flame of the recombustion burner, so that the unburnt gas whirls so as to be sufficiently agitated and slowly sucked into the flame of the burner 5. As the unburnt gas is agitated and whirls in the recombustion chamber 6 as described above, the unburnt gas resides in the recombustion chamber 6 for a relatively long time sufficient for complete combustion of the unburnt gas.

As shown by the arrows of FIG. 2, the unburnt gas is sufficiently mixed, thus to cause high temperature oxidation and to decompose the unburnt gaseous heavy metals.

As the recombustion chamber 6 includes the gas guide wall 12 extending above the port 7 in the front of the port 7 as shown in FIG. 2, the unburnt gas introduced from the main combustion chamber 4 into the recombustion chamber 6 through the port 7 whirls and comes into complete contact with the flame of the recombustion burner 5. Particularly when the top section of the wall 12 is bent in the flame throwing direction of the recombustion burner 5, the unburnt gas is more smoothly guided to the flame of the burner 5 and this improves the contact efficiency of the unburnt gas with the flame of the burner 5.

The combustion gas, after being burnt by the flame of the recombustion burner 5, whirls and passes through the flue duct 14 extending from the recombustion chamber 6 and is introduced to the combustion gas exhaust chamber 13. In the exhaust chamber 13, the combustion gas whirls upward about the injector nozzle 17 as shown in FIG. 1, which nozzle 17 is positioned in a vertical manner at the bottom of the chamber 13 and extends to about the center of the interior of the chamber 13. Therefore, the combustion gas is forcibly exhausted to the outside of the incinerator 2 or to the atmosphere through the vertically extending chimney 30. At this time, the combustion gas smoothly whirls about the injector nozzle 17 as the exhaust chamber 13 is constructed such that the combustion gas introduced from the recombustion chamber 6 through the flue duct 14 smoothly whirls in the chamber 13 and is smoothly exhausted to the atmosphere along the inside wall of the chamber 13.

In the combustion gas, after being burnt again in the recombustion chamber 6, the gaseous heavy metals have been mostly decomposed by the high temperature heat of the flame of the recombustion burner 5. However, the hydrogen chloride has not been decomposed but remains in the combustion gas. In order to remove the noxious hydrogen chloride from the combustion gas, a chemical nozzle 27 which is connected to the chemical tank 22 through the pressure pump 23 and the chemical distributing pipe line 24 is fitted into the injector nozzle 17. A chemical, such as caustic soda, of the chemical tank 22 is sprayed from the chemical nozzle 27 into the exhaust chamber 13 so that the sprayed chemical comes into pressure reducing contact with the combustion gas whirling upward about the injector nozzle 17. By this process, the noxious hydrogen chloride of the combustion gas is neutralized through the above-mentioned formula prior to exhaust of the combustion gas to the atmosphere.

The incinerator 2 of the invention is used for incinerating noxious medical wastes and lets no noxious material remain in the combustion gas and no microorganism in the ash of the waste. Furthermore, the incinerator 2 has no problem of secondary infection due to the noxious medical wastes.

In order to show the operational efficiency of the incinerator of the invention, the following examples were carried out. The following examples are merely intended to the illustrate the present invention in further detail and should by no means be considered to be limitative of the invention.

The medical waste incineration procedures of the examples were carried out, changing the composition of the medical wastes as represented in Table 1. After incineration of the medical wastes, the concentrations of the hydrogen chloride and compositions of the exhaust gases were measured and the measured results of the concentrations of the hydrogen chloride are given in Tables 2 and 4 and the average composition of the exhaust gases are given in Table 3.

The medical wastes gathered from the medical institutions were classified into three samples, that is, sample A, sample B and sample C, as represented in Table 1 or the sample classification Table.

The samples A, B and C are different from each other in the ratio of the high molecular materials thereof as shown in the following Table 1. That is, the ratio of the high molecular materials of sample A is lowest, while the ratio of the high molecular materials of the sample C is highest.

TABLE 1

(Waste Sample Classification Table)

| Classi- | Sample A | | Sample B | | Sample C | |
|---|---|---|---|---|---|---|
| fication | Ratio | Weight | Ratio | Weight | Ratio | Weight |
| Plastics | 42.2 | 1688 | 45 | 1800 | 50 | 2000 |
| Tubes | 9.2 | 368 | 15 | 600 | 26 | 1040 |
| Papers, fibers | 37.6 | 1504 | 23 | 920 | 9 | 360 |
| Ned-dles | 1.1 | 44 | 2 | 80 | 3 | 120 |
| Glass | 8.9 | 356 | 14 | 560 | 11 | 440 |
| Rubber | 1.0 | 40 | 1 | 40 | 1 | 40 |
| Sum | 100.0% | 4000 g | 100.0% | 4000 g | 100.0% | 4000 g |

The concentrations of the hydrogen chloride included in the combustion gases after individual incineration processes of the samples A, B and C were measured and the measuring results are given in Table 2.

TABLE 2

(Concentrations of the Hydrogen Chloride without processing the Neutralization)

| | Sample A | Sample B | Sample C |
|---|---|---|---|
| Concentration of Hydrogen Chloride (mg/Nm3) | 46 | 100 | 101 |

As represented in the Table 2, the concentration of the hydrogen chloride when incinerating the sample A whose ratio of the high molecular materials was lowest was 46 mg/Nm3, the concentration of the hydrogen chloride when incinerating the sample B was 100 mg/Nm3, and the concentration of the hydrogen chloride when incinerating the sample C whose ratio of the high molecular materials was highest was 101 mg/Nm3.

Therefore, it is noted that all of the concentrations of the hydrogen chloride in the combustion gases of the samples A, B and C are remarkably lower than the reference ratio 700 mg/Nm3.

The compositions of the exhaust gases after incineration of the samples A, B and C were measured and the averaged composition of the exhaust gases is given in Table 3.

TABLE 3

(Averaged Composition of the Exhaust Gases of the Samples A, B and C without neutralization process)

| | Measured | | Reference |
|---|---|---|---|
| Content | Unit | Value | Value |
| Smoke | g/Nm3 | 0.027 | 0.25 |
| Amount of sulfur oxide | Nm3/h | <0.02 | 0.032 |
| Concentration of Sulfur oxide | ppm | <10 | |
| Nitrogen oxide | ppm | 45 | 250 |

TABLE 3-continued (Averaged Composition of the Exhaust Gases of the Samples A, B and C without neutralization process)

| Content | Measured Unit | Measured Value | Reference Value |
|---|---|---|---|
| Cadmium | mg/Nm3 | <0.05 | |
| Lead | mg/Nm3 | <1 | |
| Fluoride | mg/Nm3 | <2 | |
| Hydrogen Cyanide | mg/Nm3 | <0.5 | |
| Mercury | mg/Nm3 | 0.05 | |
| Ammonium | ppm | <1 | |
| Chromium | mg/Nm3 | <0.2 | |

The results of the averaged composition of the exhaust gases shown in Table 3 was from the incineration of the samples A, B and C merely through the main combustion process and the recombustion process without the neutralization process of the present invention. In order to comparatively show the operational efficiency of the incinerator with the neutralizing means, the samples A, B and C were incinerated through the main combustion process, the recombustion process and the neutralization process, and the concentrations of the hydrogen chloride were measured and the results are given in Table 4.

TABLE 4

(Concentrations of the Hydrogen Chloride with processing the Neutralization)

| | Sample A | Sample B | Sample C |
|---|---|---|---|
| Concentration of Hydrogen Chloride (mg/Nm3) | 15 | 20 | 25 |

As represented in the Table 4, the concentration of the hydrogen chloride when incinerating the sample A was 15 mg/Nm3, the concentration of the hydrogen chloride when incinerating the sample B was 20 mg/Nm3, and the concentration of the hydrogen chloride when incinerating the sample C was 25 mg/Nm3.

Therefore, it is noted that all of the concentrations of the hydrogen chloride in the combustion gases of the samples A, B and C are remarkably lower than those of the combustion gases without the neutralization process of the present invention.

As described above, the incineration of the present invention has a port for introducing the combustion gas of the main combustion chamber into the recombustion chamber, which port is positioned such that the port is laterally spaced apart relative to the flame of the recombustion burner to enable the combustion gas vented into the recombustion chamber to come into cross contact with the flame of the recombustion burner. With such port, the unburnt gas in the combustion gas whirls so as to be sufficiently agitated in the recombustion chamber. The unburnt gas, therefore, resides in the recombustion chamber for a relatively long time and this causes the unburnt gas to be completely burnt in the recombustion chamber, i.e. increases flame contact time and hence burning time. Hence, the gaseous noxious heavy metals will be nearly completely removed from the exhaust combustion gas. Furthermore, the incinerator deodorizes the combustion gas prior to exhaust of the gas.

When incinerating the medical wastes using the incinerator of the present invention having the gas guide wall in the recombustion chamber, which wall extends above the port in the front of the port, the combustion gas including the unburnt gas introduced from the main combustion chamber changes its direction of flow and is sucked into the effective space of the flame of the recombustion burner little by little. Therefore, the unburnt gas mostly comes into contact with the flame of the recombustion burner in the effective space, and thereby achieves the desired complete combustion of the unburnt gas. Hence, there is no unburnt gas introduced into the combustion gas exhaust chamber.

In the case of use of the incinerator having the gas guide wall, which guide wall extends above the port in the front of the port and the top section of which wall is smoothly bent in the flame throwing direction of the recombustion burner, the unburnt gas is more smoothly guided to the flame of the recombustion burner and this improves the contact efficiency of the unburnt gas with the flame of the burner.

In addition, the incinerator of the present invention includes noxious gas neutralizing means for neutralizing noxious gases, such as hydrogen chloride, of the combustion gas of the recombustion chamber using a chemical and for removing the noxious gases from the combustion gas prior to the exhausting of the combustion gas into the atmosphere. The noxious gas neutralizing means includes the injector nozzle positioned vertically at the bottom of the exhaust chamber and extends to about the center of the interior of the chamber. The combustion gas introduced into the exhaust chamber whirls upward about the nozzle and is exhausted to the atmosphere through the vertically extending chimney. The neutralizing means also includes a chemical tank for containing a chemical such as caustic soda or limewater, which tank is placed in the front section of the interior of the container box of the incineration truck. The neutralizing means further includes the chemical nozzle, which chemical nozzle is fitted into the injector nozzle and connected to the chemical tank through the pressure pump and the chemical distributing pipe line. With the neutralizing means, the chemicals such as caustic soda of the chemical tank is sprayed from the chemical nozzle into the exhaust chamber so that the sprayed chemical comes into pressure reducing contact with the combustion gas whirling upward about the injector nozzle and neutralizes the noxious hydrogen chloride of the combustion gas prior to exhaust of the combustion gas. Therefore, the incinerator of the present invention with the neutralizing means causes no environmental pollution and is not bad for the health.

Another advantage of the incinerator of the invention is that the incinerator has a sterilizing effect and lets no noxious material remain in the exhaust combustion gas and no microorganism in the ash of the wastes, and has no problem of secondary infection due to the noxious medical wastes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In an incinerator which comprises a main combustion chamber including fire-resistant walls in an inner space thereof and having a main burner in a front section of said main combustion chamber; a recombustion chamber including fire-resistant walls and placed above said main combustion chamber, said recombustion chamber being provided in a rear section thereof with a recombustion burner that jets a flame to burn unburnt gas, the main combustion chamber being operatively connected to the recombustion chamber through a port, and the recombustion chamber being provided with a gas guide wall for guiding the unburnt gas; and an exhaust chamber for receiving and exhausting combustion gas from the recombustion chamber to ambient atmosphere, the improvement wherein:

said port is laterally spaced from a center of the flame jetted from said recombustion burner;

said gas guide wall is arranged and disposed in the recombustion chamber relative to the port and the recombustion burner for guiding a flow of the unburnt gas from the main combustion chamber through the port so that the unburnt gas is introduced into the flame jetted from the recombustion burner in a whirl and in crosswise contact with the flame whereby to enable complete oxidation of the unburnt gas; and said gas guide wall extends upward substantially from an edge of the port and protrudes in a direction in which the flame of said recombustion burner is jetted.

2. An incinerator as claimed in claim 1 wherein a rear section of the recombustion chamber has first and second quadrants as defined by a plane passing through said rear section longitudinally, said port opening only into a first of said quadrants, said guide wall protruding into said first quadrant between said port and a front section of the recombustion chamber.

3. An incinerator as claimed in claim 1 comprising an injector nozzle positioned centrally at a bottom of the exhaust chamber in a vertical orientation, said injector nozzle including means for causing the combustion gas from the recombustion chamber to whirl upward about said injector nozzle and to be exhausted into ambient atmosphere.

4. An incinerator as claimed in claim 3 wherein the combustion gas comprises hydrogen chloride and the incinerator comprises chemical nozzle means in the injector nozzle for spraying a chemical from a chemical supply tank into the injector nozzle and into said exhaust chamber so that the sprayed chemical comes into pressure reducing contact with the combustion gas whirling upward about said injector nozzle and neutralizes the hydrogen chloride of the combustion gas prior to the neutralized gas being exhausted into ambient atmosphere.

* * * * *